US009501006B2

(12) United States Patent
Shimokawa et al.

(10) Patent No.: US 9,501,006 B2
(45) Date of Patent: Nov. 22, 2016

(54) FIXING DEVICE, IMAGE FORMING APPARATUS, AND FIXING METHOD

(71) Applicants: Toshihiko Shimokawa, Kanagawa (JP); Ryuuichi Mimbu, Kanagawa (JP); Kazuya Saito, Kanagawa (JP); Haruyuki Honda, Kanagawa (JP); Yoshiki Yamaguchi, Kanagawa (JP); Yasunori Ishigaya, Kanagawa (JP); Yoshio Hattori, Kanagawa (JP)

(72) Inventors: Toshihiko Shimokawa, Kanagawa (JP); Ryuuichi Mimbu, Kanagawa (JP); Kazuya Saito, Kanagawa (JP); Haruyuki Honda, Kanagawa (JP); Yoshiki Yamaguchi, Kanagawa (JP); Yasunori Ishigaya, Kanagawa (JP); Yoshio Hattori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/806,560

(22) Filed: Jul. 22, 2015

(65) Prior Publication Data

US 2016/0033910 A1 Feb. 4, 2016

(30) Foreign Application Priority Data

Aug. 1, 2014 (JP) ..... 2014-157466
Jun. 23, 2015 (JP) ..... 2015-125759

(51) Int. Cl.
*G03G 15/20* (2006.01)

(52) U.S. Cl.
CPC ..... *G03G 15/2039* (2013.01)

(58) Field of Classification Search
None
See application file for complete search history.

(56) References Cited

U.S. PATENT DOCUMENTS

2002/0141772 A1* 10/2002 Kawano ..... G03G 15/2003 399/68
2002/0186986 A1* 12/2002 Makihira ..... G03G 15/2003 399/92
2007/0217819 A1* 9/2007 Sone ..... G03G 15/2039 399/122
2007/0292175 A1 12/2007 Shinshi
2008/0240748 A1* 10/2008 Kinouchi ..... G03G 15/2039 399/33
2009/0028595 A1* 1/2009 Yano ..... G03G 21/20 399/69
2010/0104301 A1* 4/2010 Kato ..... G03G 21/20 399/44
2013/0209119 A1 8/2013 Yuasa et al.
2015/0050046 A1 2/2015 Honda et al.
2015/0177659 A1 6/2015 Ishigaya et al.

FOREIGN PATENT DOCUMENTS

JP 2005156758 A * 6/2005
JP 2007-334205 12/2007
JP 2012-177790 9/2012
JP 2015-121654 7/2015

OTHER PUBLICATIONS

U.S. Appl. No. 14/641,817, filed Mar. 9, 2015.
* cited by examiner

*Primary Examiner* — David Gray
*Assistant Examiner* — Thomas Giampaolo, II
(74) *Attorney, Agent, or Firm* — Duft Borsen & Fettig LLP

(57) ABSTRACT

A fixing device includes a heater that heats a fixing rotator and includes a first heating portion and a second heating portion substantially aligned with the first heating portion in an axial direction of the fixing rotator. A multi-view thermopile array detects a temperature of an outer circumferential surface of the fixing rotator at a plurality of spots thereon. A heater controller controls the first heating portion and the second heating portion individually based on the temperature of the fixing rotator detected at the plurality of spots thereon. A recording medium conveyance controller determines whether or not to convey the recording medium to the fixing nip based on an increased temperature detected at at least one of the plurality of spots on the fixing rotator.

13 Claims, 9 Drawing Sheets

FIXING DEVICE, IMAGE FORMING APPARATUS, AND FIXING METHOD

CROSS-REFERENCE TO RELATED APPLICATIONS

This patent application is based on and claims priority pursuant to 35 U.S.C. §119 to Japanese Patent Application Nos. 2014-157466, filed on Aug. 1, 2014, and 2015-125759, filed on Jun. 23, 2015, in the Japanese Patent Office, the entire disclosure of each of which is hereby incorporated by reference herein.

BACKGROUND

1. Technical Field

Exemplary aspects of the present disclosure relate to a fixing device, an image forming apparatus, and a fixing method, and more particularly, to a fixing device for fixing a toner image on a recording medium, an image forming apparatus incorporating the fixing device, and a fixing method for fixing a toner image on a recording medium.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator pressed against the fixing rotator to form a fixing nip therebetween, through which a recording medium bearing a toner image is conveyed. A heater is disposed opposite the fixing rotator to heat the fixing rotator. The heater includes a first heating portion and a second heating portion substantially aligned with the first heating portion in an axial direction of the fixing rotator. A multi-view thermopile array is disposed opposite the fixing rotator to detect a temperature of an outer circumferential surface of the fixing rotator at a plurality of spots thereon. A heater controller is operatively connected to the thermopile array and the first heating portion and the second heating portion of the heater to control the first heating portion and the second heating portion individually based on the temperature of the fixing rotator detected at the plurality of spots thereon. A recording medium conveyance controller is operatively connected to the heater controller to determine whether or not to convey the recording medium to the fixing nip based on an increased temperature detected at at least one of the plurality of spots on the fixing rotator.

This specification further describes below an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a fixing rotator rotatable in a predetermined direction of rotation and a pressure rotator pressed against the fixing rotator to form a fixing nip therebetween, through which the recording medium bearing the toner image is conveyed. A heater is disposed opposite the fixing rotator to heat the fixing rotator. The heater includes a first heating portion and a second heating portion substantially aligned with the first heating portion in an axial direction of the fixing rotator. A multi-view thermopile array is disposed opposite the fixing rotator to detect a temperature of an outer circumferential surface of the fixing rotator at a plurality of spots thereon. A heater controller is operatively connected to the thermopile array and the first heating portion and the second heating portion of the heater to control the first heating portion and the second heating portion individually based on the temperature of the fixing rotator detected at the plurality of spots thereon. A recording medium conveyance controller is operatively connected to the heater controller to determine whether or not to convey the recording medium to the fixing nip based on an increased temperature detected at at least one of the plurality of spots on the fixing rotator.

This specification further describes below an improved fixing method. In one exemplary embodiment, the fixing method includes starting conveying a recording medium toward a fixing nip formed between a fixing rotator and a pressure rotator; determining that an increased temperature of the fixing rotator detected by a thermopile array is greater than 280 degrees centigrade; and conveying the recording medium at a productivity rate of 75 percent. The productivity rate defines a rate of an instant number of recording media per minute conveyed through the fixing nip relative to an upper limit number of recording media per minute conveyable through the fixing nip. The fixing method further includes determining that the increased temperature of the fixing rotator detected by the thermopile array is greater than 280 degrees centigrade; conveying the recording medium at the productivity rate of 50 percent; determining that the increased temperature of the fixing rotator detected by the thermopile array is greater than 280 degrees centigrade; conveying the recording medium at the productivity rate of 25 percent; determining that the increased temperature of the fixing rotator detected by the thermopile array is greater than 280 degrees centigrade; and conveying the recording medium at the productivity rate of 0 percent.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
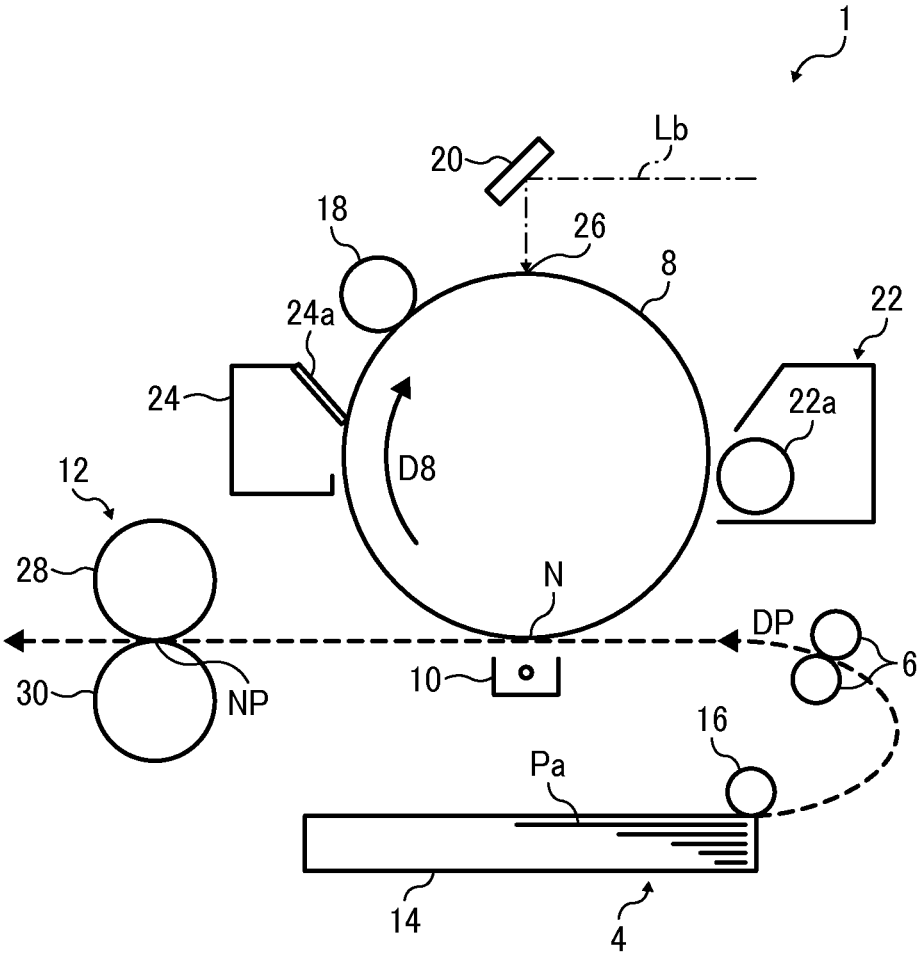
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a monochrome printer that forms a monochrome toner image on a recording medium by electrophotography. Alternatively, the image forming apparatus 1 may be a color printer that forms monochrome and color toner images on recording media.

A description is provided of a construction of the image forming apparatus 1.

As shown in FIG. 1, the image forming apparatus 1 includes a sheet feeder 4, a registration roller pair 6, a photoconductive drum 8 serving as an image bearer, a transfer device 10, and a fixing device 12. The sheet feeder 4 includes a paper tray 14 that loads a plurality of sheets Pa (e.g., a plurality of recording sheets) serving as recording media and a feed roller 16 that picks up and separates an uppermost sheet Pa from other sheets Pa of the plurality of sheets Pa loaded on the paper tray 14. Thus, the feed roller 16 feeds the sheet Pa one by one to the registration roller pair 6. The registration roller pair 6 temporarily halts the sheet Pa conveyed by the feed roller 16 to correct skew of the sheet Pa. Thereafter, the registration roller pair 6 conveys the sheet Pa to a transfer nip N formed between the photoconductive drum 8 and the transfer device 10 at a time in synchronism with rotation of the photoconductive drum 8, that is, at a time when a leading edge of a toner image formed on the photoconductive drum 8 corresponds to a predetermined position in a leading end of the sheet Pa in a sheet conveyance direction DP.

The photoconductive drum 8 is surrounded by a charging roller 18 serving as a charger, a mirror 20 constituting a part of an exposure device, a developing device 22 incorporating a developing roller 22*a*, the transfer device 10, a cleaner 24 incorporating a cleaning blade 24a, and the like, which are arranged in this order clockwise in FIG. 1 in a rotation direction D8 of the photoconductive drum 8. A light beam Lb reflected by the mirror 20 irradiates and scans the photoconductive drum 8 at an exposure position 26 thereon interposed between the charging roller 18 and the developing device 22 in the rotation direction D8 of the photoconductive drum 8, thus forming a desired electrostatic latent image on the photoconductive drum 8.

A description is provided of an image forming operation to form a toner image on a sheet Pa that is performed by the image forming apparatus 1 having the construction described above.

As the photoconductive drum 8 starts rotating, the charging roller 18 uniformly charges an outer circumferential surface of the photoconductive drum 8. The exposure device emits a light beam Lb onto the charged outer circumferential surface of the photoconductive drum 8 at the exposure position 26 thereon according to image data sent from an external device such as a client computer, thus forming an electrostatic latent image on the photoconductive drum 8. The electrostatic latent image formed on the photoconductive drum 8 moves in accordance with rotation of the photoconductive drum 8 to an opposed position thereon disposed opposite the developing device 22 where the developing device 22 supplies toner to the electrostatic latent image on the photoconductive drum 8, visualizing the electrostatic latent image as a toner image. As the toner image formed on the photoconductive drum 8 reaches the transfer nip N, the toner image is transferred onto a sheet Pa conveyed from the paper tray 14 and entering the transfer nip N at a predetermined time by a transfer bias applied by the transfer device 10.

The sheet Pa bearing the toner image is conveyed to the fixing device 12 where the sheet Pa is conveyed through a fixing nip NP formed between a fixing roller 28 serving as a fixing rotator or a fixing member and a pressure roller 30 serving as a pressure rotator or a pressure member pressed against the fixing roller 28 while the sheet Pa is sandwiched between the fixing roller 28 and the pressure roller 30. As the sheet Pa bearing the toner image is conveyed through the fixing nip NP, the fixing roller 28 and the pressure roller 30 fix the unfixed toner image on the sheet Pa under heat and pressure. Thereafter, the sheet Pa bearing the fixed toner image is ejected onto an output tray that stacks the sheet Pa. Either the fixing roller 28 or the pressure roller 30 may be driven and rotated by a driver (e.g., a motor).

As residual toner failed to be transferred onto the sheet Pa at the transfer nip N and therefore remaining on the photoconductive drum 8 moves under the cleaner 24 in accordance with rotation of the photoconductive drum 8, the cleaning blade 24a scrapes the residual toner off the photoconductive drum 8, thus cleaning the photoconductive drum 8. Thereafter, a discharger removes residual potential on the photoconductive drum 8, rendering the photoconductive drum 8 to be ready for a next image forming operation.

Figure 2:
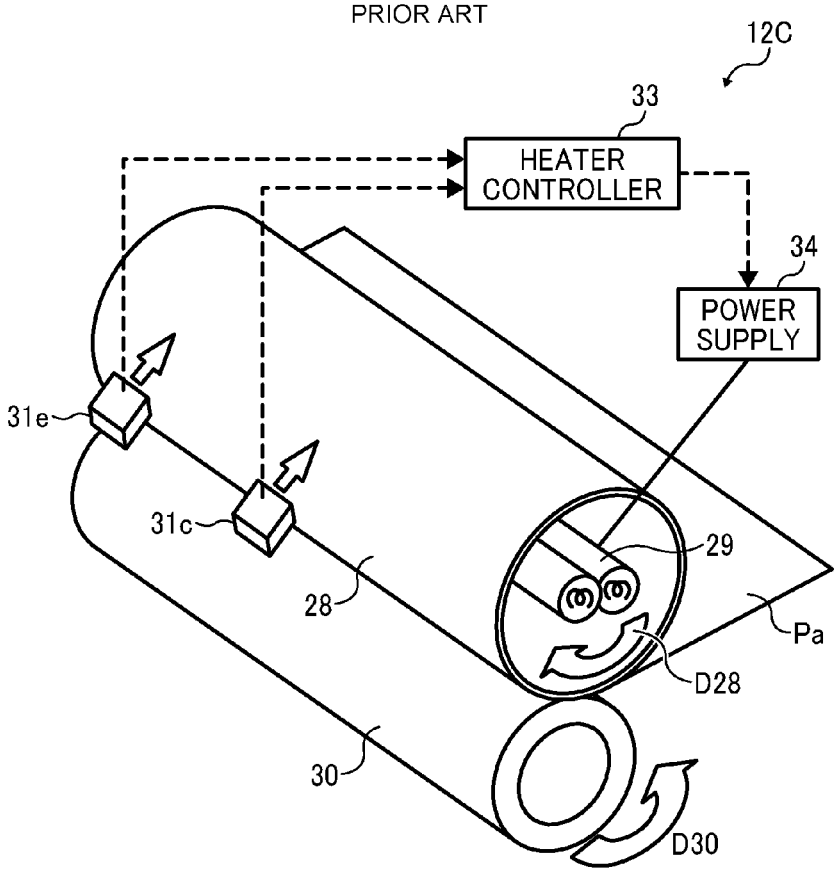
FIG. 2 PRIOR ART
FIG. 2 is a schematic perspective view of a comparative fixing device.
Figure 3:
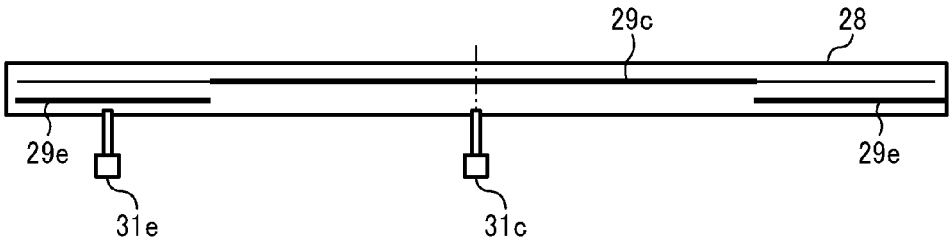
FIG. 3 PRIOR ART
FIG. 3 is a schematic plan view of a fixing roller incorporated in the comparative fixing device shown in FIG. 2.

With reference to FIGS. 2 and 3, a description is provided of a relative position of the fixing roller 28, a heater, and a temperature sensor incorporated in a comparative fixing device 12C.

FIG. 2 is a schematic perspective view of the comparative fixing device 12C. FIG. 3 is a schematic plan view of the fixing roller 28 incorporated in the comparative fixing device 12C. As shown in FIGS. 2 and 3, the comparative fixing device 12C includes a heater 29 constructed of a plurality of heating portions substantially aligned with each other in an axial direction of the fixing roller 28 to heat the fixing roller 28, that is, a center heating portion 29*c* spanning a center span in the axial direction of the fixing roller 28 and a lateral end heating portion 29*e* spanning each lateral end span in the axial direction of the fixing roller 28. The comparative fixing device 12C further includes a plurality of sensors that corresponds to the plurality of heating portions, respectively, to detect the temperature of the fixing roller 28 for temperature control. For example, a center sensor 31*c* is disposed opposite the center heating portion 29*c* and a lateral end sensor 31*e* is disposed opposite the lateral end heating portion 29*e*.

As shown in FIG. 2, the comparative fixing device 12C further includes a power supply 34 and a heater controller 33. The power supply 34 supplies power to the center heating portion 29*c* and the lateral end heating portion 29*e* based on the temperature of the fixing roller 28 detected by the center sensor 31*c* and the lateral end sensor 31*e*. The heater controller 33 controls the power supply 34. The heater controller 33 is a micro computer including a central processing unit (CPU) serving as a calculator, a read-only memory (ROM) and a random-access memory (RAM) serving as a memory, and an input-output (I/O) interface serving as an input-output device.

However, the comparative fixing device 12C has an increased number of sensors, that is, the center sensor 31*c* and the lateral end sensor 31*e*, increasing manufacturing costs.

A description is provided of a construction of the fixing device 12 according to a first exemplary embodiment that is installed in the image forming apparatus 1 depicted in FIG. 1.

Figure 4:
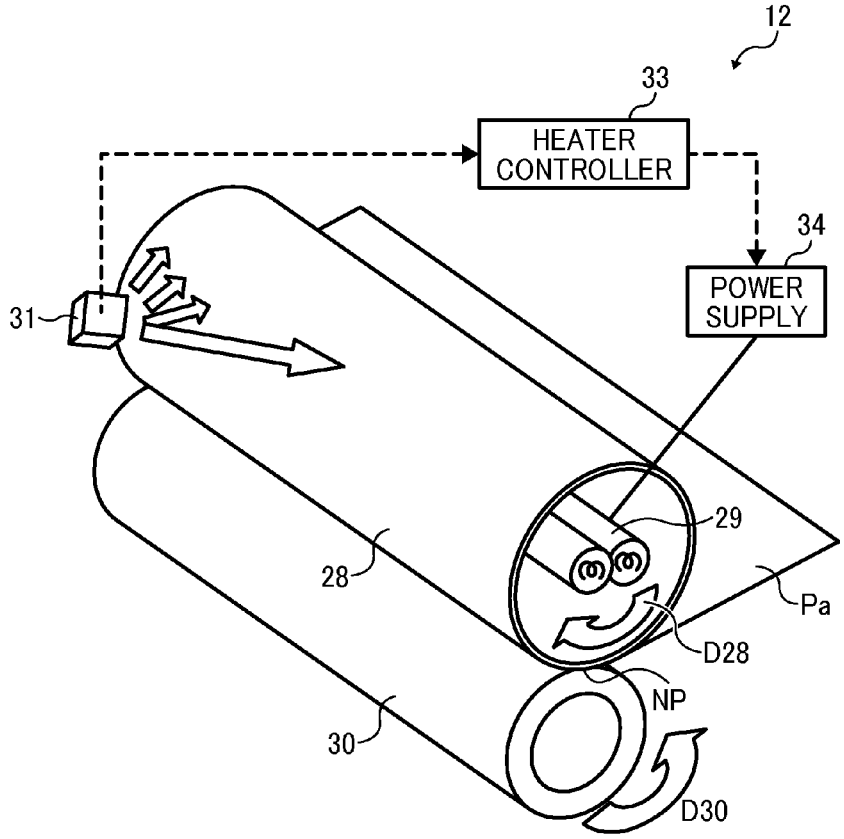
FIG. 4 is a schematic perspective view of a fixing device according to a first exemplary embodiment of the present disclosure that is installed in the image forming apparatus shown in FIG. 1.
Figure 5:
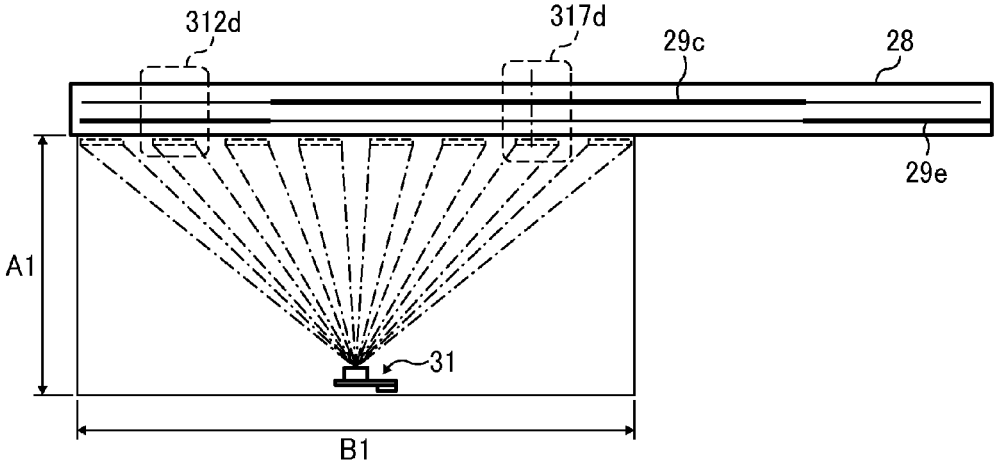
FIG. 5 is a schematic plan view of a fixing roller incorporated in the fixing device shown in FIG. 4.

FIGS. 4 and 5 show a relative position of the fixing roller 28, a heater, and a temperature sensor incorporated in the fixing device 12 according to the first exemplary embodiment. FIG. 4 is a schematic perspective view of the fixing device 12. FIG. 5 is a schematic plan view of the fixing roller 28 incorporated in the fixing device 12.

As shown in FIG. 4, the fixing device 12 (e.g., a fuser or a fusing unit) includes the fixing roller 28 rotatable in a rotation direction D28 and the pressure roller 30 rotatable in a rotation direction D30. As shown in FIGS. 4 and 5, a single multi-view thermopile array is used as a temperature sensor 31 that detects the temperature of an outer circumferential surface of the fixing roller 28 instead of the two sensors of the comparative fixing device 12C, that is, the center sensor 31*c* and the lateral end sensor 31*e* depicted in FIGS. 2 and 3.

Figure 6:
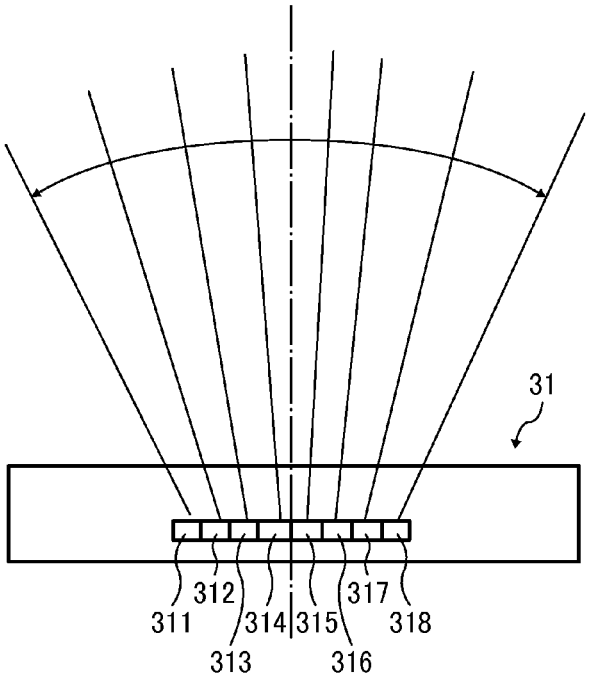
FIG. 6 is a schematic plan view of a temperature sensor incorporated in the fixing device shown in FIG. 4.

FIG. 6 is a schematic plan view of the temperature sensor 31. As shown in FIG. 6, the thermopile array serving as the temperature sensor 31 includes a plurality of detection elements (e.g., a plurality of thermopile elements) aligned inside the thermopile array. The plurality of detection elements detects the temperature of an object based on infrared rays radiated from the object. As shown in FIG. 6, each detection element has a predetermined view angle so that the temperature sensor 31 detects the temperature of the fixing roller 28 at a plurality of spots, that is, a plurality of detection spans, on the fixing roller 28 in the axial direction thereof.

As shown in FIG. 6, the temperature sensor 31 includes eight detection elements 311 to 318 within the single sensor. As shown in FIGS. 5 and 6, two of the eight detection elements 311 to 318 are used to control the heater 29. For example, the center detection element 317 detects the temperature of the fixing roller 28 in a center detection span 317*d* thereon that is used to control the center heating portion 29*c*. The lateral end detection element 312 detects the temperature of the fixing roller 28 in a lateral end detection span 312*d* thereon that is used to control the lateral end heating portion 29*e*.

The single temperature sensor 31 detects the temperature of the outer circumferential surface of the fixing roller 28 at a plurality of spots thereon in the axial direction of the fixing roller 28 to control a plurality of heating portions, that is, the two heating portions including the center heating portion 29*c* and the lateral end heating portion 29*e, reducing manufacturing costs.*

The thermopile array of the temperature sensor 31 detects the temperature of the fixing roller 28 through a single circuit by switching between the plurality of detection elements 311 to 318. Although it may take time to switch between the plurality of detection elements 311 to 318 one by one, a single CPU or the like calculates a cold junction and the temperature, reducing manufacturing costs.

As shown in FIG. 6, the temperature sensor 31 is the thermopile array including the eight detection elements 311 to 318 within the single sensor. Two of the eight detection elements 311 to 318, that is, the center detection element 317 and the lateral end detection element 312, are used to control the heater 29 including the center heating portion 29*c* and the lateral end heating portion 29*e*. Alternatively, if an arithmetic circuit is connected to other six detection elements 311, 313 to 316, and 318, the six detection elements 311, 313 to 316, and 318 may detect the temperature of the fixing roller 28.

The image forming apparatus 1 used as a copier forms a toner image on recording media of various sizes. As shown in FIG. 5, the heater 29 constructed of the two heating portions, that is, the center heating portion 29*c* spanning the center span in the axial direction of the fixing roller 28 and the lateral end heating portion 29*e* spanning each lateral end span in the axial direction of the fixing roller 28, heats a fixing sleeve constituting the outer circumferential surface of the fixing roller 28 uniformly in the center span and each lateral end span of the fixing roller 28 in the axial direction thereof Generally, recording media (e.g., sheets Pa) are centered in the axial direction of the fixing roller 28 as they are conveyed over the fixing roller 28. A center heating span of the center heating portion 29*c* in the axial direction of the fixing roller 28 corresponds to a short width of a recording medium frequently used in the axial direction of the fixing roller 28. A lateral end heating span of the lateral end heating portion 29*e* corresponds to a subtracted width of a recording medium frequently used that is obtained by subtracting a short width from a long width of the recording medium in the axial direction of the fixing roller 28. As shown in FIG. 5, the lateral end heating portion 29*e* spans each lateral end heating span disposed opposite each lateral end span of the fixing roller 28 in the axial direction thereof. A combined heating span combining one lateral end heating span of the lateral end heating portion 29*e* with another lateral end heating span of the lateral end heating portion 29*e* is equivalent to the subtracted width of the recording medium. According to this exemplary embodiment, a part of the lateral end heating portion 29*e* that spans one lateral end heating span and another part of the lateral end heating portion 29*e* that spans another lateral end heating span are under an identical control as a pair of parts of the lateral end heating portion 29*e*.

With reference to FIGS. 4 to 6, a description is provided of a heater control performed by the heater controller 33, that is, a power control to control power supply to the heater 29 by controlling the power supply 34.

Various controllers capable of controlling power supply to the heater 29 including the center heating portion 29*c* and the lateral end heating portion 29*e* are used as the heater controller 33.

When the fixing roller 28 rotates idly while no sheet Pa is conveyed through the fixing nip NP, the heater controller 33 compares temperatures of the fixing roller 28 detected by the two detection elements 317 and 312 of the temperature sensor 31 used for the heater control with target temperatures of the center heating portion 29*c* and the lateral end heating portion 29*e*, respectively, thus controlling power supply to each of the center heating portion 29*c* and the lateral end heating portion 29*e*.

When the sheet Pa is conveyed through the fixing nip NP, power supply to the heater 29 is controlled similarly to retain the temperature of a surface layer of the fixing sleeve. However, if a width of the sheet Pa is different from the center heating span of the center heating portion 29*c* and the lateral end heating span of the lateral end heating portion 29*e*, for example, if the center heating span of the center heating portion 29*c* is smaller than the width of the sheet Pa that is smaller than a combined span of the center heating span of the center heating portion 29*c* and the lateral end heating span of the lateral end heating portion 29*e* that includes an overlap span where the lateral end heating span overlaps the center heating span, an outboard span of the fixing sleeve that spans from a side edge of the sheet Pa to an outboard edge of the lateral end heating portion 29*e* in the axial direction of the fixing roller 28 is subject to temperature increase as the number of the sheets Pa conveyed through the fixing nip NP increases (hereinafter referred to as lateral end temperature increase or lateral end overheating). The lateral end heating portion 29*e* is controlled based on a temperature of the fixing sleeve at a temperature detection position thereon within the width of the sheet Pa. Accordingly, the sheet Pa draws heat from the fixing sleeve at the temperature detection position thereon, decreasing the temperature of the surface layer of the fixing sleeve at the temperature detection position.

To address this circumstance, the heater controller 33 may control the power supply 34 to supply power to the heater 29. However, heat is not conducted from the fixing roller 28 to the sheet Pa in the outboard span spanning from the side edge of the sheet Pa to the outboard edge of the lateral end heating portion 29*e* in the axial direction of the fixing roller 28, causing the lateral end temperature increase.

To address this circumstance, when the lateral end heating portion 29*e* heats the fixing roller 28 in the outboard span outboard from the side edge of the sheet Pa in the axial direction of the fixing roller 28, the temperature sensor 31 detects the temperature of the outer circumferential surface of the fixing roller 28 also in the outboard span. For example, the temperature sensor 31 detects the temperature of the outer circumferential surface of the fixing roller 28 in each of a conveyance span on the fixing roller 28 where the sheet Pa is conveyed that is inboard from the side edge of the sheet Pa in the axial direction of the fixing roller 28 and a non-conveyance span on the fixing roller 28 where the sheet Pa is not conveyed that is outboard from the side edge of the sheet Pa in the axial direction of the fixing roller 28. The heater controller 33 determines whether or not to convey the sheet Pa through the fixing nip NP based on an increased temperature, that is, a highest temperature, among temperatures of the outer circumferential surface of the fixing roller 28 detected by the temperature sensor 31.

Generally, a plurality of temperature sensors (e.g., the center sensor 31*c* and the lateral end sensor 31*e* depicted in FIG. 2) is aligned in the axial direction of the fixing roller 28 to correspond to various sizes of the sheets Pa conveyed over the fixing roller 28. The various sizes of the sheets Pa include a width of an A4 size sheet in portrait orientation and a width of the A4 size sheet in landscape orientation. The plurality of temperature sensors detects the temperature of the fixing roller 28 to adjust productivity, that is, copies per minute (cpm) down (hereinafter referred to as the cpm down), so as to protect the fixing roller 28.

Generally, in order to reduce costs, a contact temperature sensor or the like contacts a lateral end or the like of the pressure roller 30 disposed opposite the fixing sleeve, that is, the outer circumferential surface of the fixing roller 28. When a temperature of the pressure roller 30 detected by the contact temperature sensor exceeds a predetermined temperature, conveyance of the sheet Pa is interrupted and the fixing roller 28 is rotated idly to equalize the temperature of an overheated portion of the fixing roller 28 that suffers from the lateral end temperature increase, thus attaining the cpm down. However, such control may have two problems below.

A first problem is increased manufacturing costs caused by a plurality of temperature sensors that detects the temperature of the pressure roller 30. It may be difficult to allocate the plurality of temperature sensors corresponding to various widths of sheets Pa.

A second problem is the cpm down performed by estimating the temperature of the surface layer of the fixing sleeve based on the temperature of a surface layer of the pressure roller 30. The temperature of the surface layer of the pressure roller 30 as a threshold to perform the cpm down is decreased in view of an unexpected temperature differential. For example, if the surface layer of the fixing sleeve is made of tetrafluoroethylene-perfluoroalkylvinylether copolymer (PFA), a heat resistant temperature of the fixing sleeve is about 280 degrees centigrade which is determined based on a heat resistant temperature of the surface layer made of PFA. The temperature of the surface layer of the pressure roller 30 to perform the cpm down is set to about 200 degrees centigrade. Conversely, the fixing device 12 according to the first exemplary embodiment employs the thermopile array that detects the temperature of the fixing roller 28 at a plurality of spots thereon as the temperature sensor 31. Accordingly, the temperature sensor 31 detects the temperature of the surface layer of the fixing sleeve of the fixing roller 28 directly without contacting the fixing sleeve at the plurality of spots aligned in the axial direction of the fixing roller 28. Consequently, the temperature sensor 31 detects a spot on the fixing roller 28 that suffers from the substantial lateral end temperature increase quickly and precisely. A threshold temperature to perform the cpm down is near the heat resistant temperature of the surface layer made of PFA, improving productivity.

A description is provided of a construction of a fixing device 12S according to a second exemplary embodiment.

Figure 7:
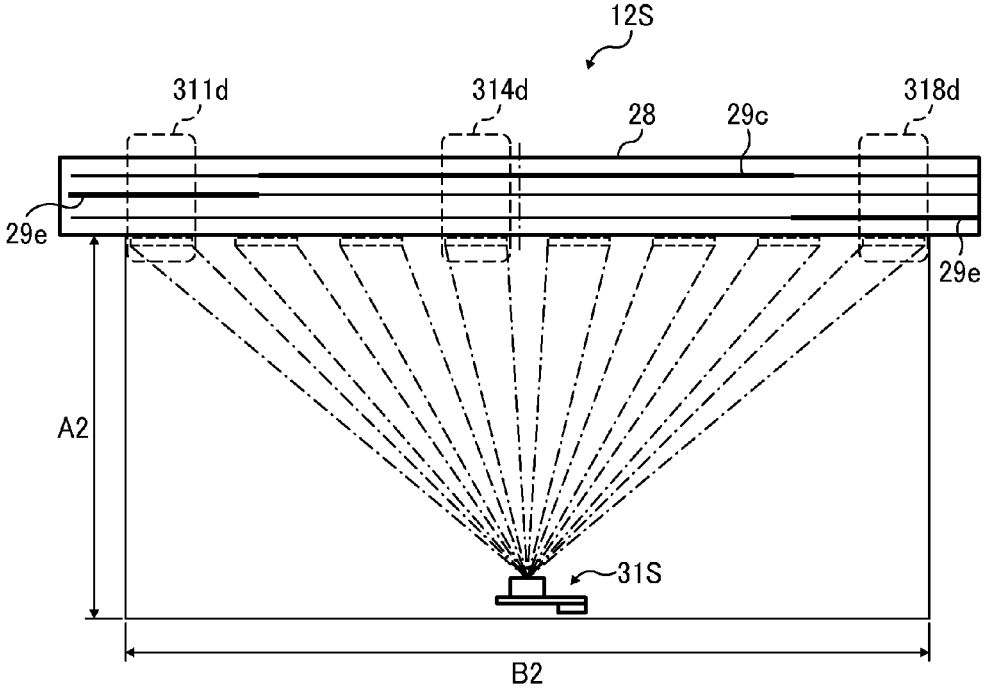
FIG. 7 is a schematic plan view of a fixing device according to a second exemplary embodiment of the present disclosure.

FIG. 7 is a schematic plan view of the fixing device 12S showing a relative position of the fixing roller 28, the heater 29, and a temperature sensor 31S incorporated in the fixing device 12S according to the second exemplary embodiment. According to the first exemplary embodiment shown in FIGS. 4 and 5, a part of the lateral end heating portion 29*e* that spans one lateral end heating span and another part of the lateral end heating portion 29*e* that spans another lateral end heating span are under the identical control as a pair of parts of the lateral end heating portion 29*e*. According to the second exemplary embodiment shown in FIG. 7, the temperature sensor 31S is spaced apart from the fixing roller 28 with an interval A2 in a direction perpendicular to the axial direction of the fixing roller 28 that is greater than an interval A1 with which the temperature sensor 31 is spaced apart from the fixing roller 28 as shown in FIG. 5. Thus, the temperature sensor 31S attains a detection span B2 spanning from one lateral end heating span of the lateral end heating portion 29*e* to another lateral end heating span of the lateral end heating portion 29*e* through the center heating span of the center heating portion 29*c* in the axial direction of the fixing roller 28. The detection span B2 is greater than a detection span B1 of the temperature sensor 31 shown in FIG. 5. Like the temperature sensor 31 depicted in FIG. 6, the temperature sensor 31 S includes the eight detection elements 311 to 318. However, the detection element 311 of the temperature sensor 31S has a lateral end detection span 311*d;* the detection element 314 has a center detection span 314*d;* and the detection element 318 has a lateral end detection span 318*d*.

Figure 8A:
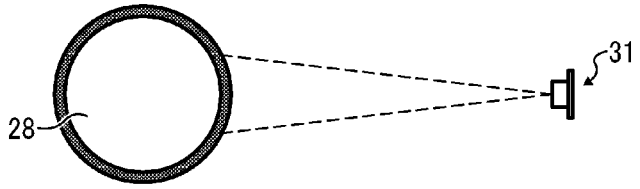
FIG. 8A is a schematic sectional view of the fixing roller and the temperature sensor of the fixing device according to the first exemplary embodiment shown in FIG. 4.
Figure 8B:
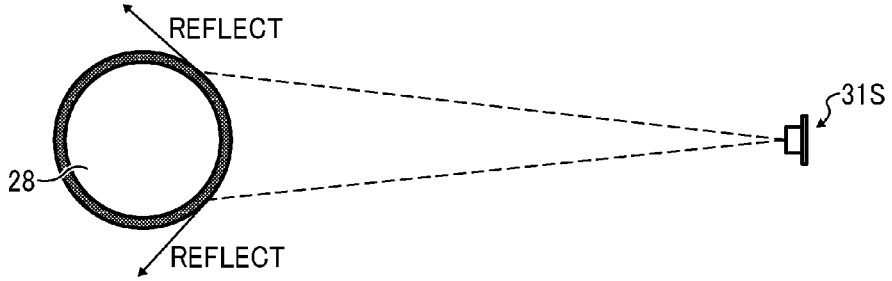
FIG. 8B is a schematic sectional view of the fixing roller and a temperature sensor of the fixing device according to the second exemplary embodiment shown in FIG. 7.

FIG. 8A is a schematic sectional view of the fixing roller 28 and the temperature sensor 31 of the fixing device 12 according to the first exemplary embodiment. FIG. 8B is a schematic sectional view of the fixing roller 28 and the temperature sensor 31S of the fixing device 12S according to the second exemplary embodiment.

The temperature sensor 31S spaced apart from the fixing roller 28 with the increased interval A2 as shown in FIG. 7 attains the detection span B2 corresponding to the substantially entire span of the fixing roller 28 in the axial direction thereof. However, the temperature sensor 31S may produce an increased circumferential non-detection span on the fixing roller 28 in a circumferential direction thereof in cross-section as shown in FIG. 8B.

FIGS. 8A and 8B illustrate the temperature sensors 31 and 31S that apparently detect the temperature of the fixing roller 28. However, the temperature sensor 31S according to the second exemplary embodiment detects the temperature of the fixing roller 28 with a decreased accuracy. For example, as shown in FIG. 8B, the temperature sensor 31S spaced apart from the fixing roller 28 with the increased interval A2 produces an increased circumferential detection span on the fixing roller 28 in the circumferential direction thereof. At a circumferential end of the circumferential detection span, infrared rays are reflected by the fixing roller 28. Accordingly, the temperature sensor 31S may detect the temperature of the fixing roller 28 by the reflected infrared rays. To address this circumstance, the fixing roller 28 may have an increased diameter. However, the increased diameter of the fixing roller 28 may degrade energy saving or increase manufacturing costs of parts. To address this circumstance, a part of the lateral end heating portion 29*e* that spans one lateral end heating span and another part of the lateral end heating portion 29*e* that spans another lateral end heating span are under the identical control as a pair of parts of the lateral end heating portion 29*e*. For example, the temperature sensor 31 detects the temperature of the fixing roller 28 at one lateral end in the axial direction thereof as in the first exemplary embodiment shown in FIGS. 4 and 5. Accordingly, even if the temperature sensor 31 is spaced apart from the fixing roller 28 with the decreased interval A1, the temperature sensor 31 identifies the temperature of the fixing roller 28 at each lateral end in the axial direction thereof, saving energy and reducing manufacturing costs of parts.

A description is provided of a construction of a comparative installation mechanism to removably install the comparative fixing device 12C into an image forming apparatus (e.g., the image forming apparatus 1 depicted in FIG. 1).

Figure 9:
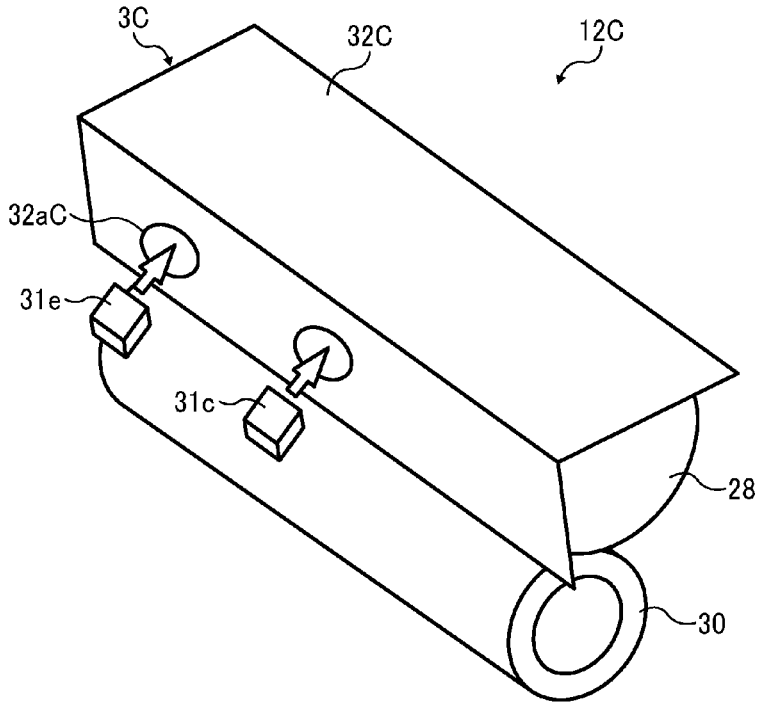
FIG. 9 PRIOR ART
FIG. 9 is a schematic perspective view of a comparative installation mechanism that removably installs the comparative fixing device shown in FIG. 2 into the image forming apparatus shown in FIG. 1.

FIG. 9 is a schematic perspective view of the comparative installation mechanism that removably installs the comparative fixing device 12C into the image forming apparatus. Although a detailed description is omitted, the comparative fixing device 12C is removably installed in the image forming apparatus. Hence, general installation mechanisms are employed except for a construction described below.

After a removable unit 3C of the fixing device 12C is removed from the image forming apparatus, the center sensor 31*c* and the lateral end sensor 31*e* separately provided from the removable unit 3C remain in the image forming apparatus. The removable unit 3C includes a cover 32C provided with a plurality of detection windows 32*c*C. The center sensor 31*c* and the lateral end sensor 31*e* situated outside the removable unit 3C and inside the image forming apparatus detect the temperature of the fixing roller 28 situated inside the removable unit 3C through the detection windows 32*c*C, respectively. Accordingly, even if the removable unit 3C is replaced with new one, the center sensor 31*c* and the lateral end sensor 31*e* are not replaced with new ones, saving resources and reducing replacement costs.

A description is provided of a construction of an installation mechanism to removably install the fixing device 12 or 12S into the image forming apparatus 1 depicted in FIG. 1.

Figure 10:
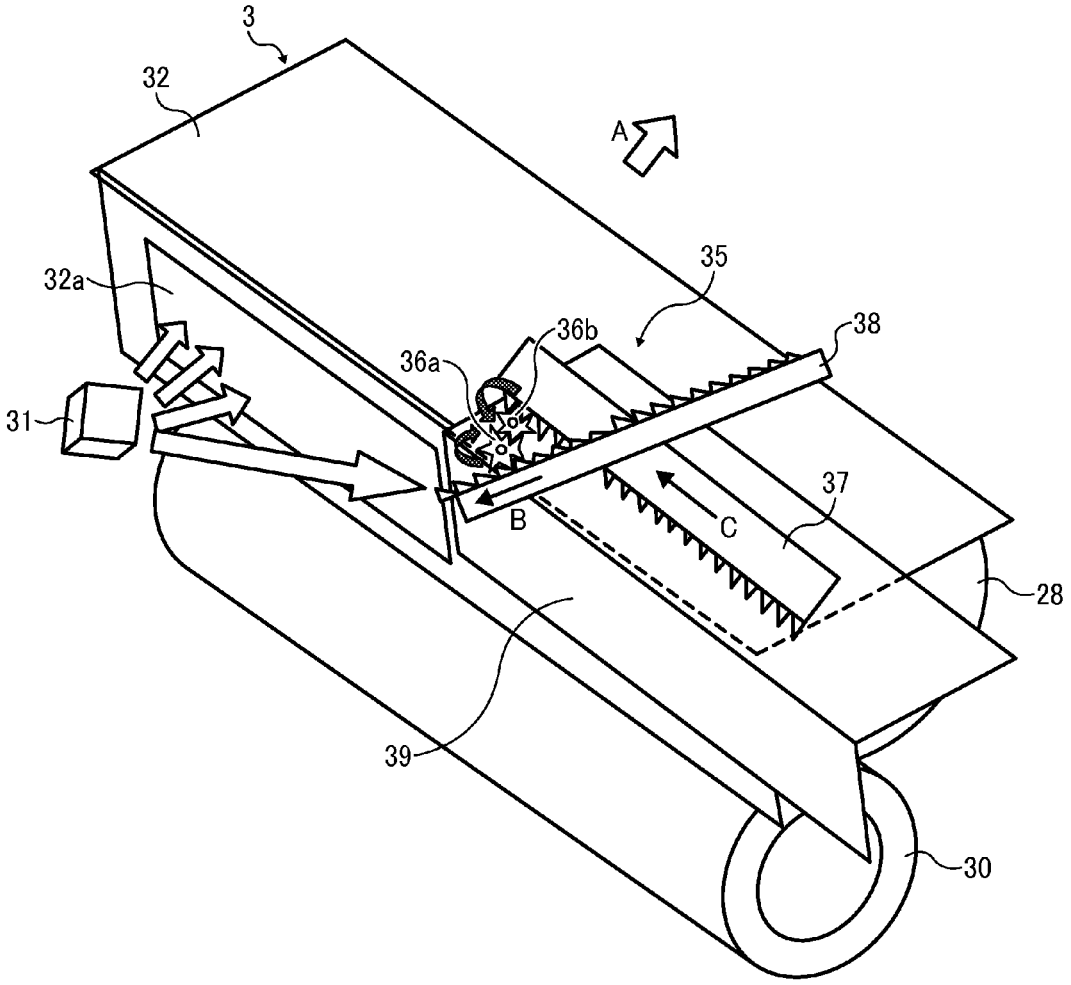
FIG. 10 is a schematic perspective view of an installation mechanism that removably installs the fixing device shown in FIGS. 4 and 7 into the image forming apparatus shown in FIG. 1.

FIG. 10 is a schematic perspective view of the installation mechanism that removably installs the fixing device 12 or 12S into the image forming apparatus 1. As shown in FIG.

10, a removable unit 3 serving as the installation mechanism of the fixing device 12 or 12S includes a cover 32 provided with a detection window 32*a* and attached with a shutter assembly 35. For example, the detection window 32*a* spans from one lateral end span to a part of the center span on the fixing roller 28 in the axial direction thereof As the removable unit 3 is removed from the image forming apparatus 1, the shutter assembly 35 shuts the detection window 32*a*.

The shutter assembly 35 includes a shutter 39, a plurality of gears 36*a* and 36*b* mounted on the removable unit 3, a rack 37 serving as a first rack mounted on the shutter 39 and meshed with the gear 36*b* serving as a first gear, and a rack 38 serving as a second rack installed in the image forming apparatus 1 and meshed with the gear 36*a* serving as a second gear. As the removable unit 3 of the fixing device 12 or 12S is removed from the image forming apparatus 1 in a direction A, the rack 38 installed in the image forming apparatus 1 moves in a direction B and is displaced relative to the gear 36*a*, thus rotating the gear 36*a* meshed with the rack 38. As the gear 36*a* rotates the gear 36*b*, the gear 36*b* moves the rack 37 mounted on the shutter 39 and meshed with the gear 36*b* in a direction C parallel to the axial direction of the fixing roller 28. Accordingly, the shutter 39 moves in the direction C to shut the detection window 32*a*. The construction of the shutter assembly 35 is not limited to that shown in FIG. 10 and therefore other constructions that shut the detection window 32*a* are available.

The cover 32 made of resin or the like covers the fixing roller 28 and the like to prevent the heated fixing roller 28 from burning a finger of a user or a service engineer when the user or the service engineer replaces the removable unit 3 with new one or removes the sheet Pa jammed between the fixing roller 28 and the pressure roller 30. However, if the center sensor 31*c* and the lateral end sensor 31*e* are located outside the removable unit 3C as shown in FIG. 9, the finger of the user or the service engineer may accidentally enter the detection window 32*c*C. Such accident may also occur in the comparative fixing device 12C shown in FIG. 2. To address this circumstance, the detection windows 32*c*C shown in FIG. 9 may be downsized to prohibit the finger of the user or the service engineer from entering the detection window 32*c*C because the center sensor 31*c* and the lateral end sensor 31*e* are configured to detect the temperature of the fixing roller 28 in a decreased detection span thereon in the axial direction thereof. However, the detection window 32*a* shown in FIG. 10 is greater than the detection window 32*c*C to allow the thermopile array of the temperature sensor 31 to detect the temperature of the fixing roller 28 in an increased detection span thereon in the axial direction thereof. Accordingly, the finger of the user or the service engineer may touch the heated fixing roller 28 through the greater detection window 32*a*. To address this circumstance, the fixing devices 12 and 12S include the shutter assembly 35 that shuts the detection window 32*a* automatically when the user or the service engineer removes the removable unit 3 from the image forming apparatus 1.

A description is provided of a communication method of the thermopile array of the temperature sensors 31 and 31S.

Figure 11:
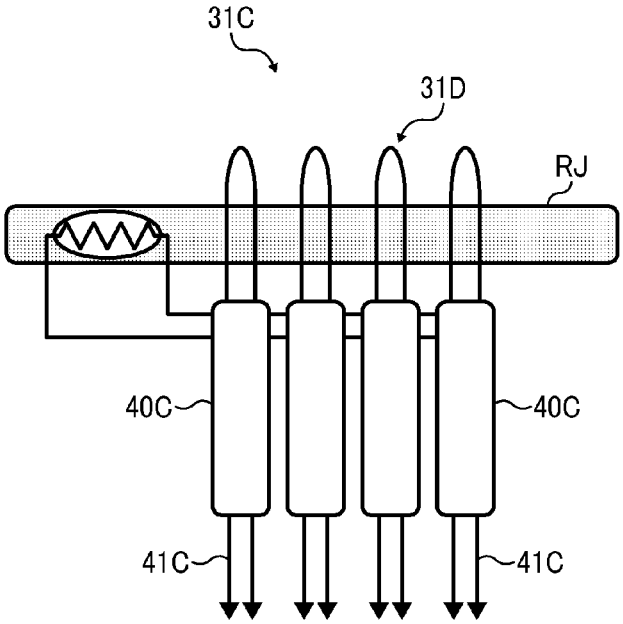
FIG. 11 PRIOR ART
FIG. 11 is a comparative circuit diagram of a comparative temperature sensor incorporated in the fixing device shown in FIG. 2.

The thermopile array includes a plurality of detection elements selectively connected to a single arithmetic circuit for calculation to detect the temperature of the outer circumferential surface of the fixing roller 28 at a plurality of spots thereon. FIG. 11 is a comparative circuit diagram of a comparative temperature sensor 31C showing a plurality of arithmetic circuits 40C corresponding to a plurality of detection elements 31D, respectively. As shown in FIG. 11, in order to increase the number of detection spots on the fixing roller 28 where the comparative temperature sensor 31C, that is, a thermopile array, detects the temperature of the fixing roller 28, the comparative temperature sensor 31C may be connected to the arithmetic circuits 40C and input-output lines 41C in an increased number, increasing manufacturing costs. A reference junction RJ, that is, a cold junction, is a temperature sensor, such as a thermistor placed on a terminal block of a thermopile, which detects the ambient temperature in proximity to the thermistor. A reference point temperature is a temperature detected at the reference junction RJ.

Figure 12:
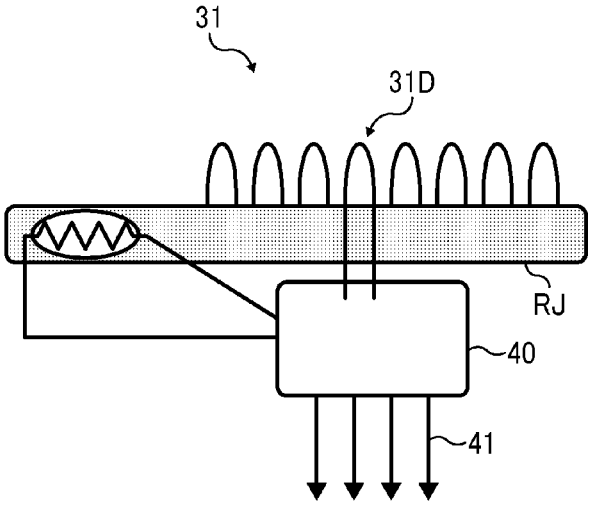
FIG. 12 is a circuit diagram of the temperature sensor shown in FIG. 6 illustrating a single arithmetic circuit corresponding to a plurality of detection elements of the temperature sensor.

To address this circumstance, the temperature sensor 31 is connected to an arithmetic circuit 40 in a decreased number as shown in FIG. 12 to reduce manufacturing costs. FIG. 12 is a circuit diagram of the temperature sensor 31 showing the single arithmetic circuit 40 corresponding to a plurality of detection elements 31D equivalent to the detection elements 311 to 318 depicted in FIG. 6 and input-output lines 41 connected to the arithmetic circuit 40. The plurality of detection elements 31D is selectively connected to the single arithmetic circuit 40 for calculation. Each of the plurality of detection elements 31D has a switch to electrically connect the plurality of detection elements 31D to the arithmetic circuit 40 in order so that the detection element 31D electrically connected to the arithmetic circuit 40 detects the temperature of the fixing roller 28. Since the detection elements 31D detect the temperature of the fixing roller 28 in order, it may take time before all the detection elements 31D finish detection. However, such circuit configuration reduces manufacturing costs. If such circuit configuration causes delay in detection, the temperature sensor 31 may be connected to a plurality of arithmetic circuits 40. For example, two arithmetic circuits 40 may be connected to the eight detection elements 31D.

Figure 13:
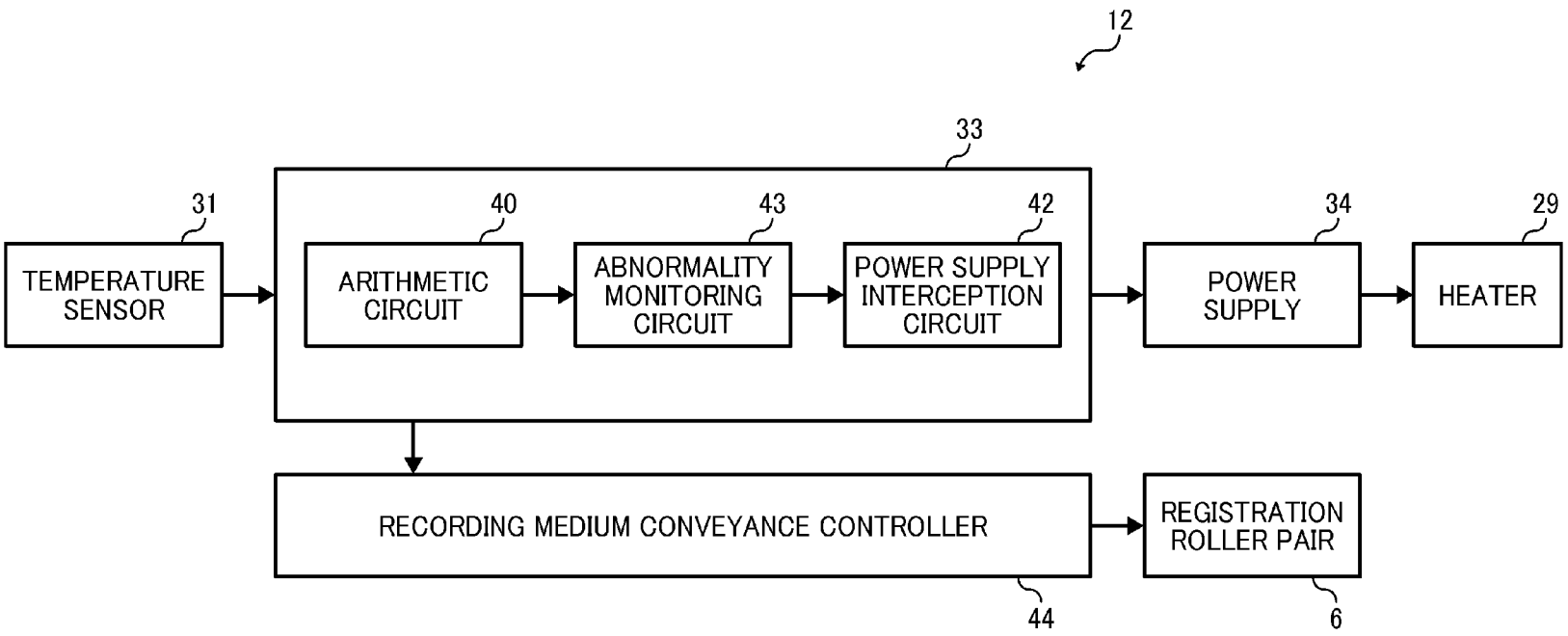
FIG. 13 is a block diagram of the fixing device shown in FIG. 4.

FIG. 13 is a block diagram of the fixing device 12. The heater controller 33 controls the heater 29 by intercepting power supply to the heater 29 through a single power supply interception circuit 42 or a plurality of power supply interception circuits 42 corresponding to the plurality of arithmetic circuits 40, respectively, according to calculated temperature data. In view of safety, fixing devices generally have a circuit to intercept power supply to the heater 29 when a temperature sensor (e.g., the temperature sensor 31C depicted in FIG. 11) detects an increased temperature, that is, overheating, of the fixing roller 28. However, if such fixing devices include the plurality of arithmetic circuits 40C as shown in FIG. 11, a plurality of power supply interception circuits corresponding to the plurality of arithmetic circuits 40C is needed. Conversely, the temperature sensor 31 depicted in FIG. 12 transmits temperatures detected by the detection elements 31D collectively, decreasing the number of the power supply interception circuits and thereby reducing manufacturing costs. As described above, the temperature sensor 31, that is, the thermopile array including the plurality of detection elements 31D, is connected to the power supply interception circuit 42 that intercepts power supply to the heater 29 when the temperature sensor 31 detects a temperature not smaller than a predetermined temperature. The temperature sensor 31 is also connected to a single abnormality monitoring circuit 43 that detects at least one of the plurality of detection elements 31D that detects an increased temperature, that is, overheating, of the fixing roller 28. It is to be noted that the configuration described above with reference to FIGS. 12 and 13 is also applied to the temperature sensor 31S depicted in FIG. 7.

A description is provided of one example of control processes to convey a sheet Pa through the fixing devices 12 and 12S.

Figure 14:
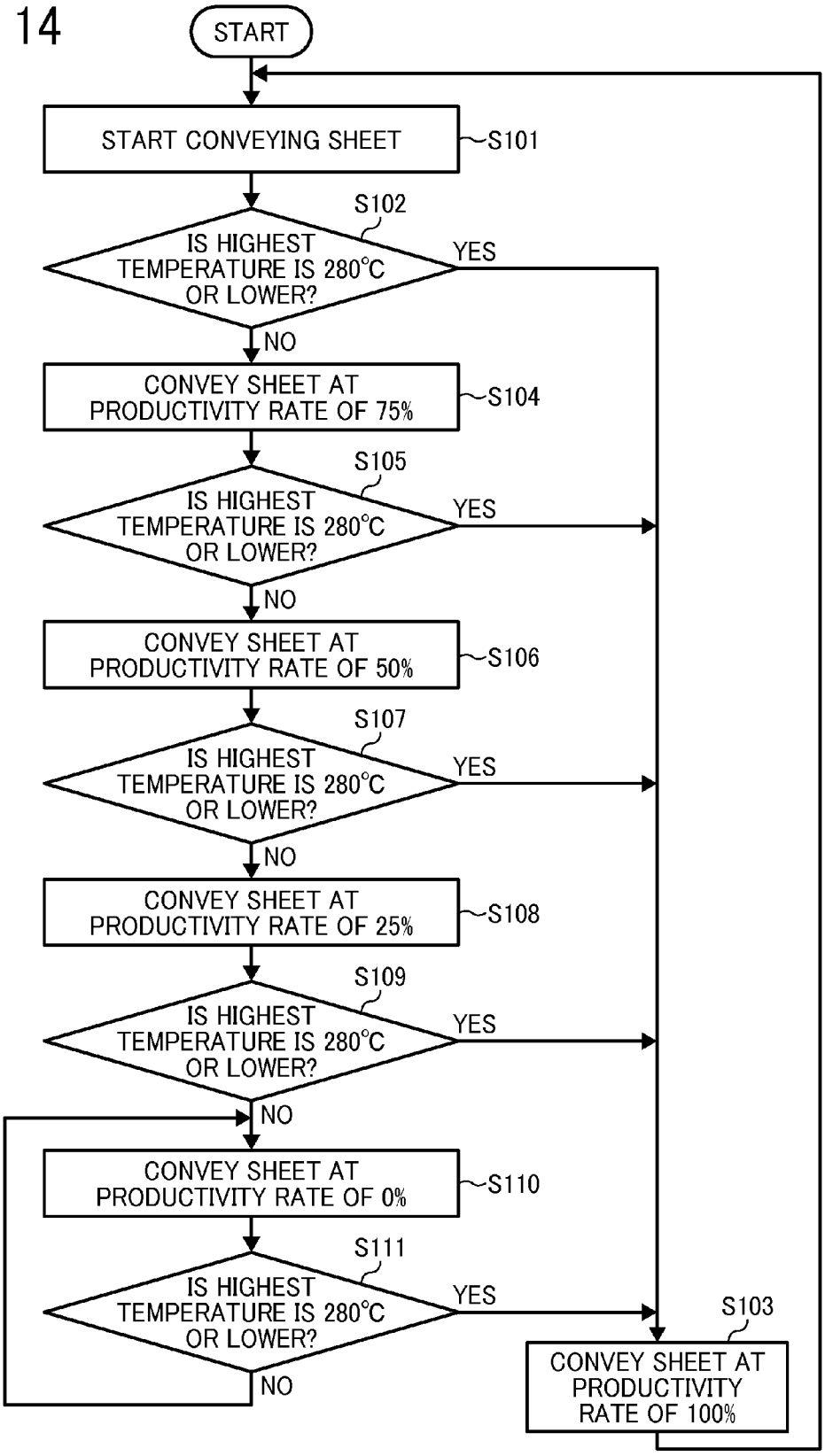
FIG. 14 is a flowchart showing control processes to convey a sheet through the fixing device shown in FIGS. 4 and 7.

FIG. 14 is a flowchart showing the control processes. A recording medium conveyance controller 44 depicted in FIG. 13 determines whether or not to convey a sheet Pa. For example, the recording medium conveyance controller 44 controls a time to convey the sheet Pa according to the control processes shown in FIG. 14. Although the control processes shown in FIG. 14 are explained below with reference to the temperature sensor 31, the control processes are also applied to the temperature sensor 31S depicted in FIG. 7.

In step S101, the recording medium conveyance controller 44 starts conveying a sheet Pa. In step S102, the recording medium conveyance controller 44 determines whether or not an increased temperature, that is, a highest temperature, of the fixing roller 28 detected by each of the detection elements 31D of the temperature sensor 31 is 280 degrees centigrade or lower. If the recording medium conveyance controller 44 determines that the highest temperature of the fixing roller 28 is 280 degrees centigrade or lower (YES in step S102), the recording medium conveyance controller 44 determines to convey the sheet Pa at a productivity rate of 100 percent, that is, at a maximum cpm or an upper limit cpm of the specification of the image forming apparatus 1, in step S103, starting conveying the sheet Pa in step S101. Conversely, if the recording medium conveyance controller 44 determines that the highest temperature of the fixing roller 28 is higher than 280 degrees centigrade (NO in step S102), the recording medium conveyance controller 44 determines to convey the sheet Pa at a productivity rate of 75 percent, defining a time to convey the sheet Pa under the cpm down in step S104.

In step S105, the recording medium conveyance controller 44 determines whether or not the highest temperature of the fixing roller 28 detected by each of the detection elements 31D of the temperature sensor 31 is 280 degrees centigrade or lower. If the recording medium conveyance controller 44 determines that the highest temperature of the fixing roller 28 is 280 degrees centigrade or lower (YES in step S105), the recording medium conveyance controller 44 determines to convey the sheet Pa at the productivity rate of 100 percent, that is, at the maximum cpm or the upper limit cpm of the specification of the image forming apparatus 1, in step S103, starting conveying the sheet Pa in step S101. Conversely, if the recording medium conveyance controller 44 determines that the highest temperature of the fixing roller 28 is higher than 280 degrees centigrade (NO in step S105), the recording medium conveyance controller 44 determines to convey the sheet Pa at a productivity rate of 50 percent, defining a time to convey the sheet Pa under the cpm down in step S106.

In step S107, the recording medium conveyance controller 44 determines whether or not the highest temperature of the fixing roller 28 detected by each of the detection elements 31D of the temperature sensor 31 is 280 degrees centigrade or lower. If the recording medium conveyance controller 44 determines that the highest temperature of the fixing roller 28 is 280 degrees centigrade or lower (YES in step S107), the recording medium conveyance controller 44 determines to convey the sheet Pa at the productivity rate of 100 percent, that is, at the maximum cpm or the upper limit cpm of the specification of the image forming apparatus 1, in step S103, starting conveying the sheet Pa in step S101. Conversely, if the recording medium conveyance controller 44 determines that the highest temperature of the fixing roller 28 is higher than 280 degrees centigrade (NO in step S107), the recording medium conveyance controller 44 determines to convey the sheet Pa at a productivity rate of 25 percent, defining a time to convey the sheet Pa under the cpm down in step S108.

In step S109, the recording medium conveyance controller 44 determines whether or not the highest temperature of the fixing roller 28 detected by each of the detection elements 31D of the temperature sensor 31 is 280 degrees centigrade or lower. If the recording medium conveyance controller 44 determines that the highest temperature of the fixing roller 28 is 280 degrees centigrade or lower (YES in step S109), the recording medium conveyance controller 44 determines to convey the sheet Pa at the productivity rate of 100 percent, that is, at the maximum cpm or the upper limit cpm of the specification of the image forming apparatus 1, in step S103, starting conveying the sheet Pa in step S101. Conversely, if the recording medium conveyance controller 44 determines that the highest temperature of the fixing roller 28 is higher than 280 degrees centigrade (NO in step S109), the recording medium conveyance controller 44 determines to convey the sheet Pa at a productivity rate of zero percent (e.g., down reload or idle rotation of the fixing roller 28), defining a time to convey the sheet Pa under the cpm down in step S110.

In step S111, the recording medium conveyance controller 44 determines repeatedly whether or not the highest temperature of the fixing roller 28 detected by each of the detection elements 31D of the temperature sensor 31 is 280 degrees centigrade or lower. If the recording medium conveyance controller 44 determines that the highest temperature of the fixing roller 28 is 280 degrees centigrade or lower (YES in step S111), the recording medium conveyance controller 44 determines to convey the sheet Pa at the productivity rate of 100 percent, that is, at the maximum cpm or the upper limit cpm of the specification of the image forming apparatus 1, in step S103, starting conveying the sheet Pa in step S101. Conversely, if the recording medium conveyance controller 44 determines that the highest temperature of the fixing roller 28 is higher than 280 degrees centigrade (NO in step S111), the recording medium conveyance controller 44 continues to convey the sheet Pa at the productivity rate of zero percent (e.g., down reload or idle rotation of the fixing roller 28), defining a time to convey the sheet Pa under the cpm down in step S110.

As described above, the recording medium conveyance controller 44 controls the time to convey the sheet Pa to the fixing nip NP such that the productivity rate changes from 100 percent to 75 percent, 50 percent, 25 percent, and 0 percent (e.g., down reload or idle rotation of the fixing roller 28). The time to convey the sheet Pa to the fixing nip NP is controlled not by adjusting the process linear velocity of the sheet Pa but by causing the registration roller pair 6 depicted in FIGS. 1 and 13 to halt the sheet Pa temporarily. The control processes shown in FIG. 14 do not select the productivity rate from two alternatives of 100 percent and 0 percent but do select the productivity rate from three or more graded rates, improving productivity of the fixing devices 12 and 12S and the image forming apparatus 1.

As described above with reference to FIGS. 4 to 7, the heater controller 33 controls the heater 29 including the plurality of heating portions, that is, the center heating portion 29*c* and the lateral end heating portion 29*e*, based on the temperature of the fixing roller 28 detected by the single temperature sensor 31 or 31S. The temperature sensors 31 and 31S detect the temperature of the outer circumferential surface of the fixing roller 28 directly at the plurality of spots on the fixing roller 28 aligned in the axial direction thereof, reducing manufacturing costs and improving productivity.

A description is provided of advantages of the fixing devices 12 and 12S.

As shown in FIGS. 4 to 7 and 13, the fixing devices 12 and 12S include a fixing rotator (e.g., the fixing roller 28) rotatable in a predetermined direction of rotation (e.g., the rotation direction D28) to come into contact with an unfixed toner image on a recording medium (e.g., a sheet Pa); a pressure rotator (e.g., the pressure roller 30) pressed against the fixing rotator to form the fixing nip NP therebetween; a heater (e.g., the heater 29) disposed opposite the fixing rotator to heat the fixing rotator; a heater controller (e.g., the heater controller 33) operatively connected to the heater to control the heater; and a temperature sensor (e.g., the temperature sensors 31 and 31S) disposed opposite the fixing rotator to detect the temperature of the fixing rotator. As the recording medium bearing the unfixed toner image is conveyed through the fixing nip NP, the fixing rotator and the pressure rotator fix the toner image on the recording medium under heat and pressure. A recording medium conveyance controller (e.g., the recording medium conveyance controller 44) determines whether or not to convey the recording medium to the fixing nip NP. The heater includes a plurality of heating portions (e.g., the center heating portion 29*c* and the lateral end heating portion 29*e*). The temperature sensor includes a multi-view thermopile array that detects the temperature of an outer circumferential surface of the fixing rotator. The thermopile array detects the temperature of the fixing rotator at a plurality of spots thereon. The heater controller is operatively connected to the plurality of heating portions to control the heating portions individually based on the temperature of the fixing rotator detected at the plurality of spots thereon. The recording medium conveyance controller determines whether or not to convey the recording medium to the fixing nip NP based on an increased temperature, that is, a highest temperature, detected at one of the plurality of spots on the fixing rotator. The heater controller controls the plurality of heating portions based on the temperature of the fixing rotator detected by the single temperature sensor. The temperature sensor detects the temperature of the outer circumferential surface of the fixing rotator at the plurality of spots aligned on the fixing rotator in an axial direction thereof.

That is, the single temperature sensor is used to control the two heating portions, reducing manufacturing and wiring costs of the temperature sensor. Accordingly, it is not necessary to install a temperature sensor that detects the temperature of the pressure rotator. Additionally, the single temperature sensor detects the temperature of the outer circumferential surface of the fixing rotator directly at the plurality of spots thereon aligned in the axial direction of the fixing rotator. Consequently, the heater heats the fixing rotator to an upper limit temperature, improving productivity. When the fixing rotator is heated to the upper limit temperature, the recording medium conveyance controller determines to perform the cpm down quickly.

According to the exemplary embodiments described above, the fixing roller 28 serves as a fixing rotator. Alternatively, a fixing belt, a fixing film, a fixing sleeve, or the like may be used as a fixing rotator. Further, the pressure roller 30 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device of an image forming apparatus, the fixing device comprising:

a fixing rotator rotatable in a predetermined direction of rotation;

a pressure rotator pressed against the fixing rotator to form a fixing nip therebetween, through which a recording medium bearing a toner image is conveyed;

a heater disposed inside the fixing rotator to heat the fixing rotator;

a multi-view thermopile array disposed opposite the fixing rotator to detect a temperature of an outer circumferential surface of the fixing rotator at a plurality of spots substantially aligned with each other in an axial direction of the fixing rotator thereon;

a heater controller operatively connected to the thermopile array and the heater to control the temperature of the fixing rotator detected at the plurality of spots thereon;

a recording medium conveyance controller operatively connected to the heater controller to determine whether or not to convey the recording medium to the fixing nip based on a highest temperature among results of detected temperatures from all of the plurality of spots on the fixing rotator; and a removable unit removably installed in the image forming apparatus and accommodating the fixing rotator, the pressure rotator, and the heater, wherein the thermopile array is disposed outside the removable unit;

wherein the removable unit includes a cover covering the fixing rotator and provided with a detection window through which the thermopile array detects the temperature of the fixing rotator, and a shutter to shut the detection window when the removable unit is removed from the image forming apparatus.

2. The fixing device according to claim 1, wherein the heater controller includes a power supply interception circuit to intercept power supply to the heater when the thermopile array detects a temperature of the fixing rotator that is not smaller than a predetermined temperature.

3. The fixing device according to claim 1, wherein the thermopile array includes:

a first detection element; and a second detection element aligned with the first detection element in the axial direction of the fixing rotator.

4. The fixing device according to claim 3, wherein the heater controller includes an arithmetic circuit selectively connected to the first detection element and the second detection element of the thermopile array to detect the temperature of the fixing rotator at the plurality of spots thereon.

5. The fixing device according to claim 3, wherein the heater controller includes an abnormality monitoring circuit to detect one of the first detection element and the second detection element that detects increased temperature of the fixing rotator.

6. The fixing device according to claim 3, wherein the heater includes a first heating portion, and a second heating portion substantially aligned with the first heating portion in the axial direction of the fixing rotator;

wherein the first heating portion of the heater is disposed opposite a center span on the fixing rotator in the axial direction thereof and the second heating portion of the heater is disposed opposite lateral end spans on the fixing rotator in the axial direction thereof, and wherein the first detection element of the thermopile array detects a temperature of the center span on the fixing rotator and the second detection element of the thermopile array detects a temperature of one of the lateral end spans on the fixing rotator.

7. The fixing device according to claim 1, wherein the thermopile array remains inside the image forming apparatus after the removable unit is removed from the image forming apparatus.

8. The fixing device according to claim 1, wherein the detection window spans from a lateral end span to a part of a center span on the fixing rotator in the axial direction thereof.

9. The fixing device according to claim 1, wherein the shutter moves in the axial direction of the fixing rotator to shut the detection window.

10. The fixing device according to claim 9, wherein the removable unit further includes:

a first rack mounted on the shutter;

a first gear meshing with the first rack;

a second gear meshing with the first gear; and a second rack meshing with the second gear, and wherein as the removable unit is removed from the image forming apparatus, the second rack moves to rotate the second gear and the first gear that in turn move the first rack that moves the shutter to shut the detection window.

11. The fixing device according to claim 1, wherein the fixing rotator includes a fixing roller and the pressure rotator includes a pressure roller.

12. An image forming apparatus comprising:

an image bearer to bear a toner image; and a fixing device disposed downstream from the image bearer in a recording medium conveyance direction to fix the toner image on a recording medium, the fixing device including:

a fixing rotator rotatable in a predetermined direction of rotation;

a pressure rotator pressed against the fixing rotator to form a fixing nip therebetween, through which the recording medium bearing the toner image is conveyed;

a heater disposed inside the fixing rotator to heat the fixing rotator, a multi-view thermopile array disposed opposite the fixing rotator to detect a temperature of an outer circumferential surface of the fixing rotator at a plurality of spots substantially aligned with each other in an axial direction of the fixing rotator thereon;

a heater controller operatively connected to the thermopile array and heater to control the temperature of the fixing rotator detected at the plurality of spots thereon; and a recording medium conveyance controller operatively connected to the heater controller to determine whether or not to convey the recording medium to the fixing nip based on a highest temperature among results of detected temperatures from all of the plurality of spots on the fixing rotator;

wherein the fixing device further includes a removable unit removably installed in the image forming apparatus and accommodating the fixing rotator, the pressure rotator, and the heater, wherein the thermopile array is disposed outside the removable unit;

wherein the removable unit includes a detection window through which the thermopile array detects the temperature of the fixing rotator, and a shutter to shut the detection window when the removable unit is removed from the image forming apparatus.

13. The image forming apparatus according to claim 12, wherein the thermopile array remains inside the image forming apparatus after the removable unit is removed from the image forming apparatus.

* * * * *